United States Patent [19]

Crump

[11] Patent Number: 4,776,779

[45] Date of Patent: Oct. 11, 1988

[54] FLUID MOTOR OR PUMP

[75] Inventor: Lewis R. Crump, Marmion, Australia

[73] Assignee: Wassan Pty Ltd., South Perth, Australia

[21] Appl. No.: 945,779

[22] Filed: Dec. 23, 1986

Related U.S. Application Data

[63] Continuation-in-part of Ser. No. 803,060, Nov. 15, 1985, abandoned.

[30] Foreign Application Priority Data

Mar. 21, 1984 [AU] Australia ..... PG4177
Mar. 21, 1985 [WO] PCT Int'l Appl. ..... PCT/AU85/00057

[51] Int. Cl.[4] ..... F01C 1/16; F01C 11/00
[52] U.S. Cl. ..... 418/197; 418/200
[58] Field of Search ..... 418/9, 10, 197, 200, 418/201

[56] References Cited

U.S. PATENT DOCUMENTS

| | | | |
|---|---|---|---|
| 2,105,428 | 1/1938 | Maglott | 418/206 |
| 2,481,527 | 9/1949 | Nilsson | 60/39.36 |
| 2,588,888 | 3/1952 | Sennet | 418/201 |
| 2,975,963 | 3/1961 | Nilsson | 418/200 |
| 4,648,817 | 3/1987 | Mariani | 418/206 |

*Primary Examiner*—John J. Vrablik
*Attorney, Agent, or Firm*—Harness, Dickey & Pierce

[57] ABSTRACT

A rotodynamic fluid machine comprising a plurality of separate coaxial cylindrical chambers in each of which a drive rotor is positioned. The drive rotors mesh with corresponding sealing rotors and have blades that are curved in such a manner so that if the rotors are placed in abutting relationship that the blades on one rotor will mate with the contiguous blades of the other rotor and extend around the circumference of the rotor so as to overlap in a circumferential direction.

5 Claims, 3 Drawing Sheets

FLUID MOTOR OR PUMP

CROSS-REFERENCE TO RELATED APPLICATION

This application is a continuation-in-part of my co-pending Application Ser. No. 803,060, filed Nov. 15, 1985, now abandoned.

BACKGROUND OF THE INVENTION

This invention relates to a rotodynamic fluid machine which can perform useful work on a fluid as a pump or compressor or which can derive useful work from a fluid as a fluid motor.

In one form the invention resides in a rotodynamic fluid machine comprising a plurality of separate co-axial cylindrical chambers, each chamber having a drive rotor mounted therein, the drive rotors being fixedly mounted on a common shaft to provide a drive rotor assembly, each rotor having a plurality of spiral blades formed thereon, the blades on the respective rotors being arranged so that if the rotors were to be placed in end-to-end abutting relationship the blades would be contiguous with the contiguous blades having an angle of wrap exceeding 360/n where n is the number of blades on each drive rotor so that neighbouring contiguous blades overlap in the longitudinal direction of the rotor axis, each drive rotor mating with a pair of sealing rotors located in lateral chambers positioned parallel to the cylindrical chamber and intersecting the cylindrical chamber, said sealing rotors being fixedly mounted on respective common shafts to provide respective sealing rotor assemblies, said sealing rotors being provided with spiral recesses to receive the spiral blades of the driving rotors to provide continuous meshing engagement between the drive rotor assembly and each sealing rotor assembly, each said central chamber being divided into two working chambers by the drive rotor and the two sealing rotors therein, the two working chambers being disposed one to each side of the line of centres of the drive rotor and the two sealing rotors, each working chamber having an inlet port and an outlet port circumferentially spaced from the inlet port.

There is at all times one drive rotor of the drive rotor assembly in meshing engagement with its mating sealing rotors of the sealing rotor assemblies. This ensures that the drive rotor assembly and two sealing rotor assemblies remain in synchronisation.

Preferably, said inlet and outlet ports of each working chamber extend substantially the full axial length of the working chamber.

Preferably, said inlet port for each working chamber is located adjacent to the pitch point between one sealing rotor and the drive rotor, and the outlet port is located adjacent to the pitch point between the other sealing rotor and the drive rotor.

BRIEF DESCRIPTION OF THE DRAWINGS

The invention will be better understood by reference to the following description of one specific embodiment thereof as shown in the accompanying drawings in which.

DETAILED DESCRIPTION OF THE PREFERRED EMBODIMENT

Figure 1:
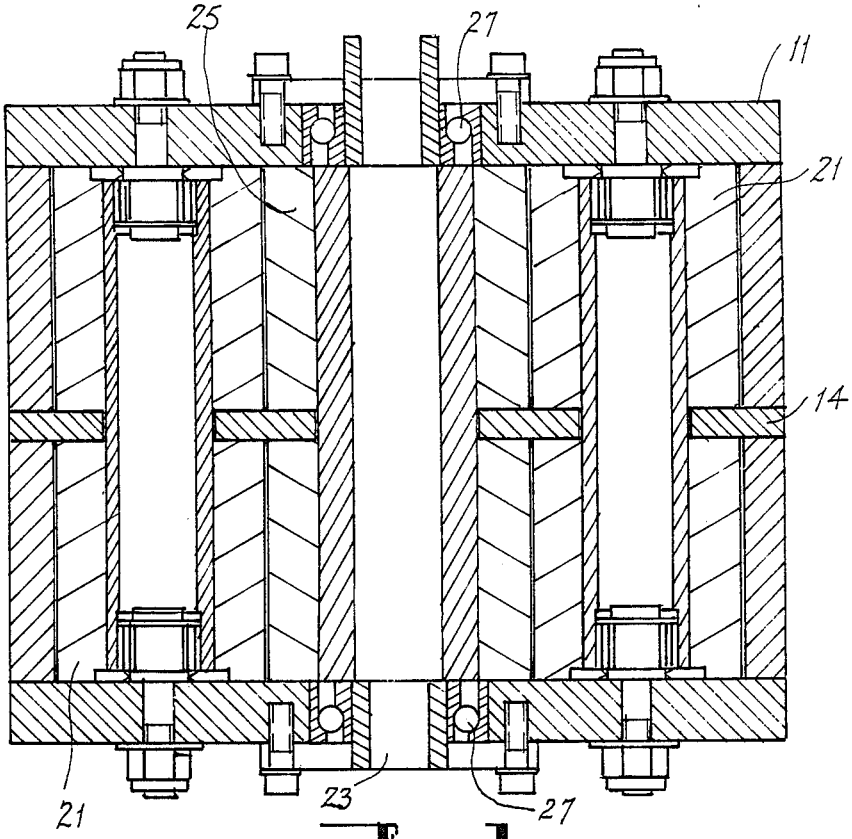
FIG. 1 is a sectional plan view of a rotodynamic fluid machine according to the embodiment.
Figure 7:
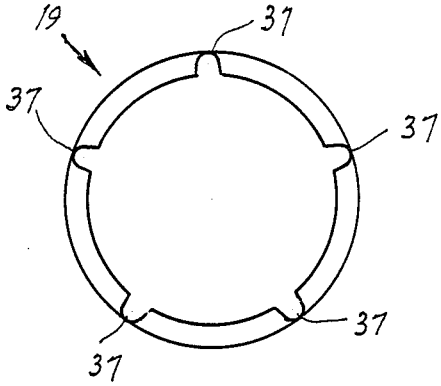
FIG. 7 is an end view of one drive rotor.
Figure 2:
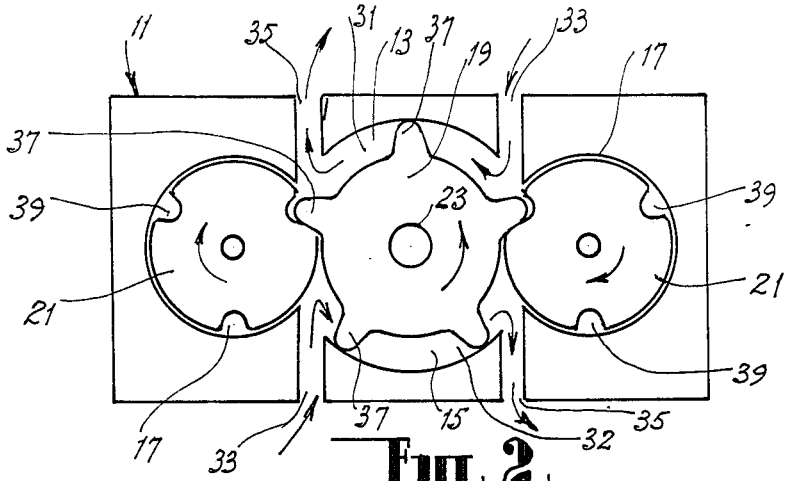
FIG. 2 is a schematic end view of the fluid machine.
Figure 4:
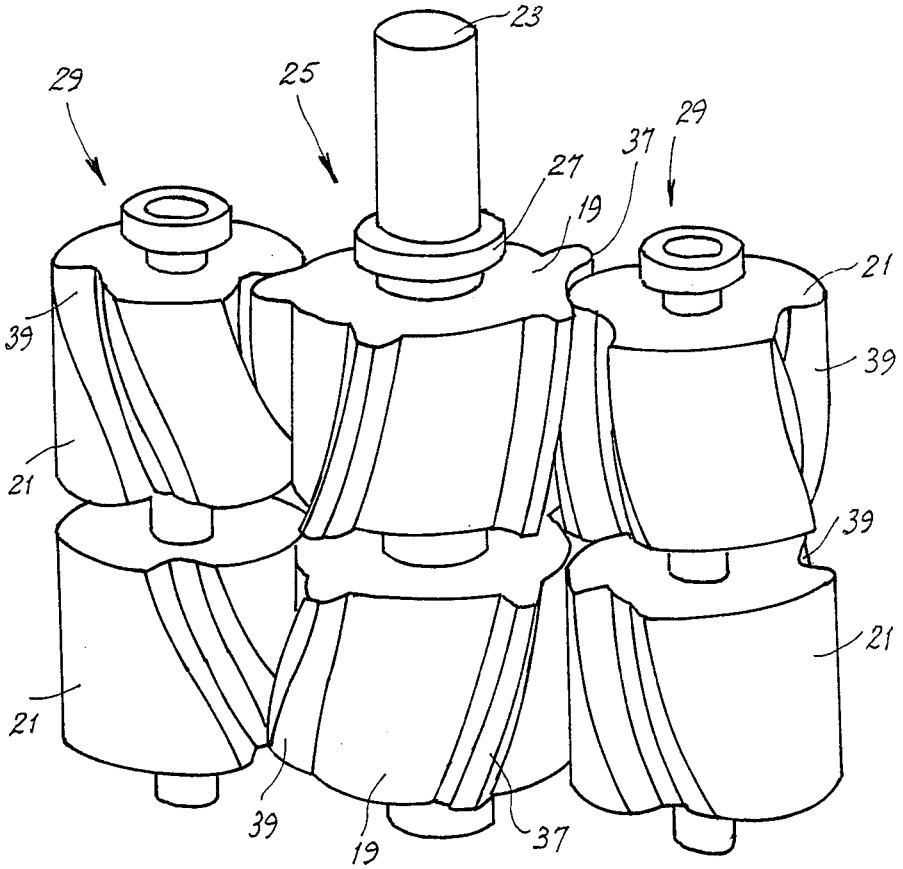
FIG. 4 is a perspective view illustrating the drive rotor assembly and the two sealing rotor assemblies.
Figure 3:
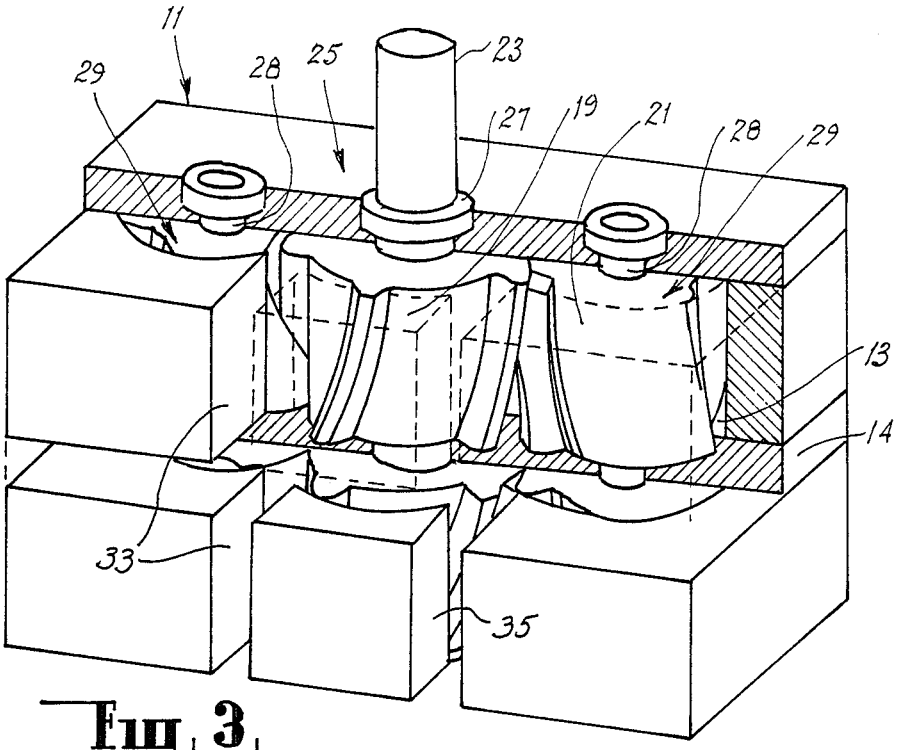
FIG. 3 is a perspective view of the fluid machine with part of the casing cut-away to reveal the drive and sealing rotors.
Figure 5:
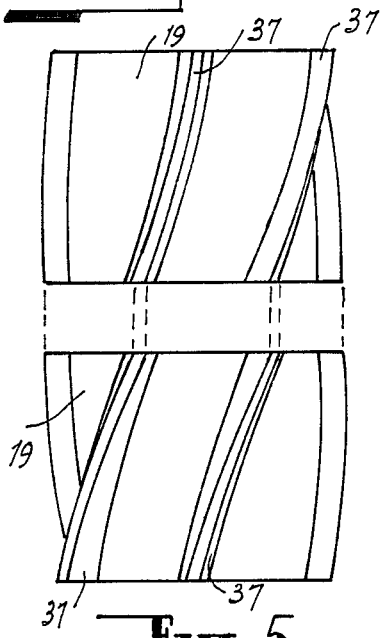
FIG. 5 is an elevational view of two drive rotors.

The embodiment shown in the drawings is directed to a rotodynamic fluid machine having two working sections which may operate in stages or independently of each other. The machine comprises a casing 11 defining a plurality of compartments 13 one corresponding to each working section of the machine. Each compartment is separated from the adjacent compartment by a wall plate 14. Each compartment comprises a cylindrical central chamber 15 and a pair of cylindrical lateral chambers 17 positioned parallel to the central chamber and merging therewith, as best seen in FIG. 2.

Within each compartment there is drive rotor 19 and a pair of sealing rotors 21, the drive rotor being positioned in the central chamber 15 and the sealing rotors being positioned one in each lateral chamber 17.

The drive rotors are fixed on a common shaft 23 to provide a drive rotor assembly 25. The common shaft extends through the central chambers and is supported in bearings 27 mounted in the casing. The shaft projects beyond one end of the casing so as to provide an input or output shaft. The sealing rotors are mounted on respective common shafts 28 to provide respective sealing rotor assemblies 29. Each shaft is journalled in the casing.

The drive rotor and two sealing rotors in each compartment divide the compartment into two working chambers 31 and 32 respectively positioned on opposed sides of the line of centres of the the drive rotor and the sealing rotors. Each working chamber 31, 32 has circumferentially spaced inlet and outlet ports 33 and 35 respectively, each extending the full length of the compartment. The inlet port is located adjacent to the pitch point between one sealing rotor and the drive rotor and the outlet port is located adjacent to the pitch point between the other sealing rotor and the drive rotor, as shown in FIG. 2. With this arrangement, fluid entering each working chamber through the inlet port thereof is transported to the outlet port through which the fluid leaves the chamber.

Figure 6:
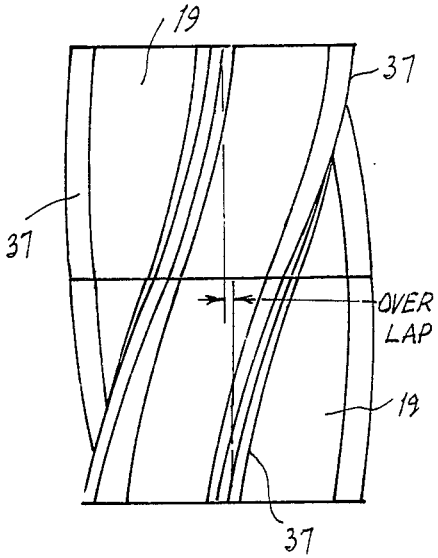
FIG. 6 is a view similar to FIG. 5 except that the rotors are placed in end-to-end abutting relationship to illustrate that the blades are contiguous.

The drive rotors each have a plurality of spiral blades 37 formed thereon, the blades of the respective rotors being so arranged that if the rotors were to be assembled in end-to-end abutting relation, the blades would be contiguous. This is illustrated in FIG. 6 of the drawings in which there is shown two such rotors placed in such end-to-end relationship. The angle of wrap of each series of contiguous blades (being the angle through which the series of contiguous blades turn) over the axial length of the assembly of rotors is greater than 360/n where n is the number of blades on each drive rotor. In this embodiment, each rotor has five spiral blades and so the angle of wrap exceeds 72°. The amount by which the wrap angle exceeds 360/n is preferably such that the overlap of one series of blade over a successive series of blade is approximately equal to the width of one blade.

The blades provide an effective seal between the inlet and outlet ports of each working chamber.

The sealing rotors 21 are provided with sprial recesses 39 to receive the spiral blades of the mating drive rotor to provide continuous meshing engagement between the drive rotor assembly and each sealing rotor assembly. Because the drive rotor assembly remains in constant meshing engagement with each sealing rotor assembly, there is no need for timing gears to maintain synchronisation between the drive rotor and sealing rotor assemblies.

The rotodynamic machine can perform useful work on a fluid as a pump or compressor, in which case shaft 23 is rotated by an external power source and fluid is drawing into each working chamber at the inlet port thereof and discharged from the outlet port.

Alternatively, the rotodynamic machine can drive useful work from a fluid as a fluid motor, in which case fluid is supported under pressure to each working chamber through the inlet port thereof so as to cause rotation of the shaft.

In each case, there is at all times one drive rotor of the drive rotor assembly is in meshing engagement with its mating sealing rotors in the sealing rotor assemblies. This ensures that the drive rotor assembly and two sealing rotor assemblies remain in synchronisation.

The working sections may operate independently of each other or in stages. Additionally, the axial lengths of the drive rotors may vary so as to provide the working sections with varying capacities. Drive rotors of varying diameters may also provide working sections with varying capacities.

The claims defining the invention are as follows:

I claim:

1. A rotodynamic fluid machine comprising a plurality of separate co-axial cylindrical chambers, each chamber having a drive rotor mounted therein, said drive rotors being fixedly mounted on a common shaft to provide a drive rotor assembly, each drive rotor having a plurality of spiral blades formed thereon, the blades on the respective drive rotors being arranged so that if the rotors were to be placed in end-to-end abutting relationship the blades would be contiguous with the contiguous blades having an angle of wrap exceeding 360/n where n is the number of blades on each drive rotor so that neighboring contiguous blades overlap in the longitudinal direction of the rotor axis, each drive rotor mating with a pair of sealing rotors located in lateral chambers positioned parallel to the respective cylindrical chamber and intersecting the respective cylindrical chamber, said sealing rotors being fixedly mounted in pairs on respective common shafts to provide a pair of respective sealing rotor assemblies, said sealing rotors being provided with spiral recesses to receive said spiral blades of said driving rotors to provide continuous meshing engagement between the drive rotor assembly and each sealing rotor assembly, each said central cylindrical chamber being divided into two working chambers by the drive rotor and the two sealing rotors therein, the two working chambers being disposed one to each side of the line of centres of the drive rotor and the two sealing rotors, each working chamber having an inlet port and an outlet port circumferentially spaced from the inlet port.

2. A rotodynamic fluid machine according to claim 1 wherein the inlet and outlet ports of each working chamber extend substantially the full axial length of the working chamber.

3. A rotodynamic fluid machine according to claim 1 wherein said inlet port for each working chamber is located adjacent to the pitch point between one sealing rotor and the drive rotor, and the outlet port is located adjacent to the pitch point between the other sealing rotor and the drive rotor.

4. A rotodynamic fluid machine according to claim 3 wherein the overlap between neighbouring blades is approximately equal to the width of one blade.

5. A rotodynamic fluid machine according to claim 1 wherein the two sealing rotor assemblies are disposed on diametrically opposed sides of the drive rotor assembly.

* * * * *